United States Patent [19]

Seragnoli

[11] 4,415,127

[45] Nov. 15, 1983

[54] METHOD AND DEVICE FOR REPLACING A FIRST, NEARLY EMPTY REEL OF STRIP MATERIAL WITH A SECOND, NEW REEL

[75] Inventor: Enzo Seragnoli, Bologna, Italy

[73] Assignee: G. D Societa' per Azioni, Bologna, Italy

[21] Appl. No.: 308,670

[22] Filed: Oct. 5, 1981

[30] Foreign Application Priority Data

Dec. 22, 1980 [IT] Italy ..... 3598 A/80

[51] Int. Cl.[3] ..... B65H 19/18; B65H 19/16

[52] U.S. Cl. ..... 242/58.1; 242/58.4; 156/504

[58] Field of Search ..... 242/58.3, 58.1, 58.2, 242/58.4, 56 A; 156/504, 505, 506

[56] References Cited

U.S. PATENT DOCUMENTS

| | | | |
|---|---|---|---|
| Re. 26,528 | 2/1969 | Anderson | 242/58.3 |
| 1,815,179 | 7/1931 | Ball | 242/58.3 |
| 1,995,269 | 3/1935 | Tomlin | 242/58.3 |
| 2,745,464 | 5/1956 | Auerbacher | 242/58.4 X |
| 4,077,580 | 3/1978 | Lang | 242/58.3 |

*Primary Examiner*—Stuart S. Levy
*Assistant Examiner*—Lloyd D. Doigan
*Attorney, Agent, or Firm*—Merriam, Marshall & Bicknell

[57] ABSTRACT

A method and device for replacing a first, empty reel of strip material with a second, new reel in which the strips of the two reels are positioned over one another and partly cut thereby forming on them coincident lines of perforations or weakening, the strip from the empty reel then being broken along the associated partly cut line and the remaining part of the strip from the empty reel being connected to the other strip, the part of which disposed downstream from the associated line of cut then being cut off after the said connection between the strips.

5 Claims, 2 Drawing Figures

METHOD AND DEVICE FOR REPLACING A FIRST, NEARLY EMPTY REEL OF STRIP MATERIAL WITH A SECOND, NEW REEL

BACKGROUND OF THE INVENTION

The present invention relates to a method for the substitution of a first reel of strip material which is running out, with a second, new reel on an operating utiliser machine.

In machines such as, for example, cigarette wrapping machines, in which strip material, for example paper strip wound on a reel is used, it is necessary to effect substitution of a reel which is about to run out with a new reel without any break in the continuity of the strip which is undesireable for the good operation of the machine. For the purpose of resolving the above problem it is known to use an automatic reel changing device in which the strip running out and a strip wound on a new reel, one on the other, are made to advance at the same speed, simultaneously cut by means of a shear and then connected together with the tail of the old strip in contact with the head of the new strip along the line of cut.

The automatic reel changing device described above has numerous disadvantages mainly due to the fact that the new strip, once cut, can only be made to advance at the same speed as the old strip by thrust and not by traction. This fact affords notable difficulty in maintaining the two strips in contact along the line of cut before being connected together. Very often, in fact, it happens that the strips, once cut, become slightly spaced from one another forming a discontinuity which is sometimes undesireable. For the purpose of eliminating the above described disadvantage it is known to provide a reel changing device in which the said two strips are glued together before cutting, preferably by interposing between them a double sided adhesive tape, the two strips then being cut subsequent to their connection. Such a reel changing device eliminates the possibility that discontinuity of the strip should occur, but introduces significant structural complications given the evident difficulty of introducing the said adhesive tape between the strips and of subsequently cutting the strips after their connection.

SUMMARY OF THE INVENTION

The object of the present invention is that of providing a method which permits, in a simple and economic manner, automatic exchange of an exhausted reel with a new reel and connection of their strips without a break in continuity.

The said object is achieved by the present invention in that it relates to a method for the substitution of a first, empty reel of strip material with a second, new reel on a utiliser machine, characterised by the fact that it comprises the steps of causing the strip of the second reel to advance by traction means and imparting to it, before the first reel is empty, a speed of advance equal to that of the strip of the first reel;

effecting, with cutting means disposed along a section of the path of the strips in which the second strip runs in close proximity to the first, a partial cut simultaneously to the two strips;

stopping, by clamping means, the part of the strip from the first reel disposed upstream from the said partial cut in such a way as to snap the strip itself along the partial cut;

providing adhesive material across the partial cut, by glueing means, in such a way as to connect the part of the strip of the first reel disposed downstream from the partial cut to the part of the strip of the second reel disposed upstream of the partial cut;

cutting the strip of the second reel along the partial cut by further cutting means disposed downstream of the said glueing means along the said section of the path.

The present invention also relates to a device for the performance of the method defined above.

According to the present invention there is provided a device for the substitution of a first, exhausted reel of strip material with a second, new reel on a utiliser machine, the device being characterised by the fact that it comprises, in combination, a first and a second support for a first and a second reel respectively, the said first reel being able to unwind and being constituted by a first strip extending along a first unwinding path; means for supporting a second strip, constituting the second reel, along a second path; traction means for imparting to the said second strip a speed of advance equal to that of the said first strip; first cutting means for effecting simultaneously a partial cut on each of the said two strips, clamping means for stopping the part of the said first strip located upstream of the said partial cut; glueing means for applying adhesive material across the said partial cut; and second cutting means disposed downstream of the said glueing means for cutting the said second strip along the said partial cut.

BRIEF DESCRIPTION OF THE DRAWINGS

Further characteristics and advantages of the present invention will become apparent from the following description made with reference to the attached drawings, which illustrate a non-limitative exemplary embodiment, in which.

DETAILED DESCRIPTION OF THE INVENTION

Figure 1:
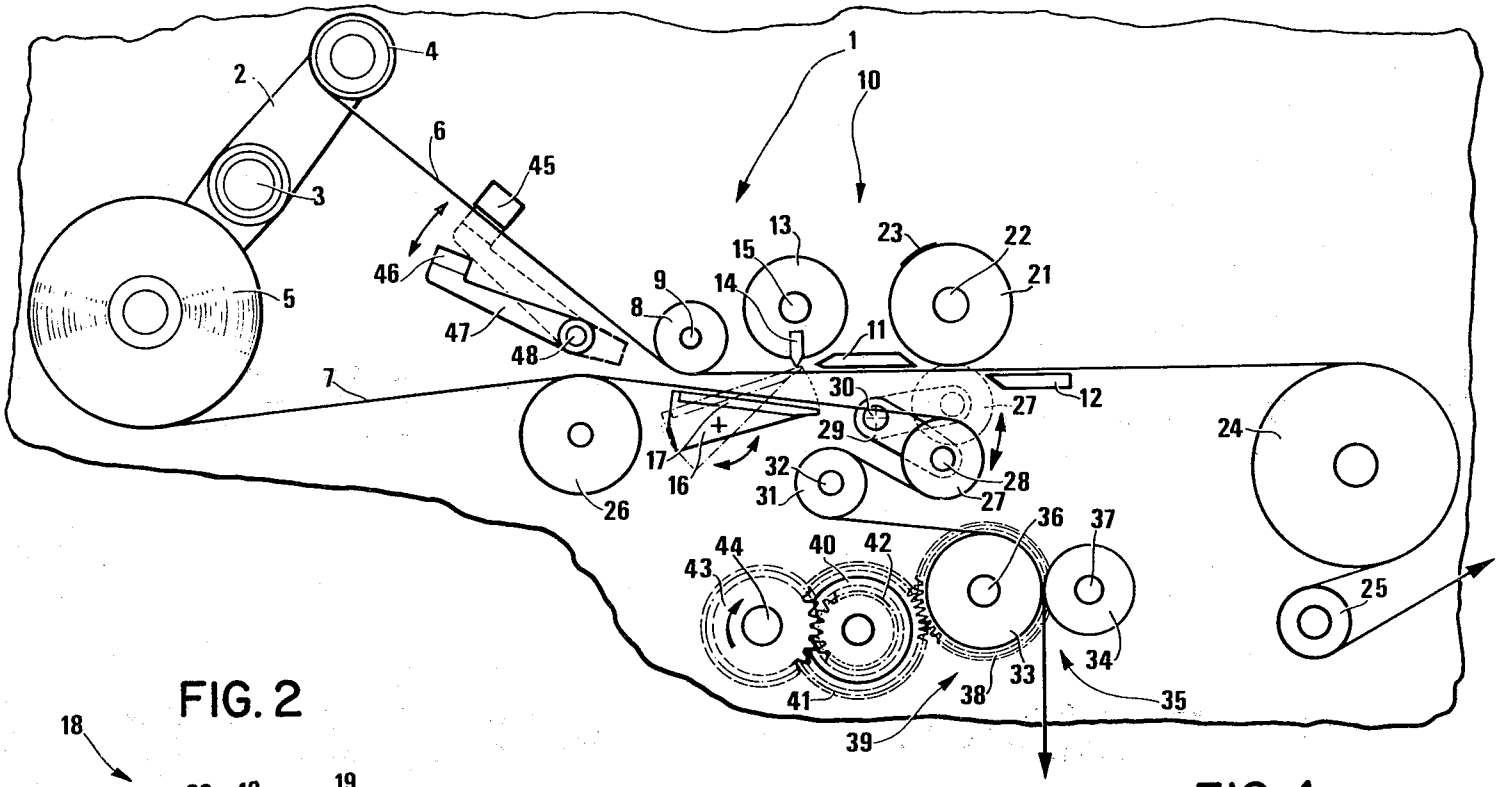
FIG. 1 schematically illustrates, in elevation, an automatic reel changing mechanism formed according to the principles of the present invention.

In FIG. 1 there is illustrated an automatic reel changing device indicated generally with the reference numeral 1 and comprising an arm 2 mounted rotatably on a central pin 3 and supporting rotatably on its ends two reels respectively indicated 4,5 the axes of rotation of which are located parallel to the pin 3.

The first of the reels 4,5 located above the other, is used while the second is in a waiting state on its support pin. The reels 4,5 are constituted by respective strips 6,7 the first of which extends in contact with a deflection roll 8 freely mounted on a shaft 9 disposed immediately upstream of a cutting and connection station generally indicated 10. The station 10 includes a flat bed defined by a plate 11 and by a blade or cutting means 12 disposed alongside and at a certain distance from one another, the first above and the second below the strip 6. Above the strip 6 and immediately upstream of the plate 11 there is disposed a cutting roll 13 provided with a radial blade 14, keyed onto a driven shaft 15 the axis of which is parallel to that of the pin 3 and disposed at a distance from the strip 6 such as to maintain the cutting edge of the blade 14 always spaced from the strip 6. Below the roll 13 there is arranged a rocking support element 16 to which there is rigidly connected a blade 17 the cutting edge of which can follow a curving path which intersects the circular path of the cutting edge of the blade 14 at a point disposed immediately below the strip 6.

Figure 2:
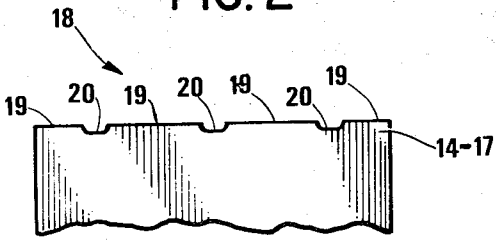
FIG. 2 illustrates a detail of FIG. 1 in plan and on an enlarged scale.

As illustrated in FIG. 2, the blades 14,17 each have a cutting edge 18 constituted by a plurality of rectilinear sections 19 each of which is separated from the adjacent rectilinear section by a notch 20.

The station 10 further includes an adhesive-applying roller 21 freely mounted on a shaft 22 and supporting on its outer periphery an adhesive tape 23.

The adhesive-applying roller 21 is located above the strip 6 between the plate 11 and the blade 12.

The strip 6, once it has passed the cutting station 10, turns about two deflection rollers 24,25 before being fed to a utiliser device, not illustrated, which can impart to the strip 6 a given unwinding tension. The strip 7 from the reel 5 is normally disposed, as previously mentioned, in a waiting position beneath the strip 6. In particular, the strip 7 extends in contact with a deflection roller 26 and the upper surface of the blade 17, and then turns about a pressure roller 27 freely mounted on an arm 29 keyed to a support pin parallel to the pin 3 and operable in such a way as to displace the roller 27 between a lowered position illustrated in solid outline in FIG. 1, and a raised position (illustrated in broken outline in FIG. 1) to contact the outer periphery of the adhesive-applying roller 21.

The strip 7 then turns about a deflection roller 31 freely mounted on a shaft 32 and extends between two rollers 33, 34 in contact with one another. The rollers 33, 34 constitute a traction device 35 for the strip 7 and are mounted on respective shafts 36, 37. In particular, the roller 34 is freely mounted on the shaft 37, while the roller 33 is keyed to the shaft 36, which is connected for turning movement with a gear wheel 38 which is the output gear of a transmission 39. This latter includes an electro magnetic powder coupling 40 an output gear 41 of which is connected to the gear 38, and an input gear 42 of which is coupled to a gear 43 keyed onto a drive shaft 44. The strip 6 extends, upstream of the roller 8, between two jaws 45, 46 the first of which is fixed, while the second is movable and is located at the end of a rocker arm 47 pivoted on a shaft 48 and connected, at the end of the other arm, to actuator means, not illustrated, operable to impart to the rocker 47 an oscillating movement to displace the jaw 46 towards and away from the jaws 45.

In use, when the reel 4 is nearly exhausted, a sensor (not illustrated) sends an excitation signal to a motor (not illustrated) connected to the drive shaft 44 so as to set it in rotation. The rotation of the shaft 44 causes, by means of the drive chain 43,42,40,41 & 38 the rotation of the roller 33 and, therefore, of the roller 34.

By means of the powder coupling 40 the peripheral speed of the rollers 33, 34 can be made to increase in an absolutely uniform manner until the speed of advance of the strip 7 is exactly equal to the speed of advance of the strip 6.

As illustrated in FIG. 1, the section of the strip 7 subtended between the rollers 26, 27 is disposed substantially alongside the section of strip 6 lying between the roll 8 and the blade 12. When the speed of the strip 7 is equal to the speed of the strip 6 the above mentioned section of the strip 7 is caused to approach the corresponding section of the strip 6 by means of a rotation of the arm 29 towards the blade 12. In particular, the arm 29 is displaced towards the blade 12 until the roller 27 displaces the strip 7 into contact with the strip 6 and the periphery of the adhesive-applying roller 21.

Simultaneously, the rocking support element 16 is turned towards the blade 14 in such a way as to carry the cutting edge 18 of the blade 17 to cooperate with the cutting edge 18 of the blade 14 through the two strips 6, 7. Given the particular form of cutting edges 18 the engagement of the two blades 14, 17 does not cause the complete cutting of the strips 6, 7 but only the formation in these of a line of partial cut or weakening since the strips 6, 7 are cut by rectilinear sections 19 of the edges 18 but remain whole in correspondence with the notches 20.

Simultaneously with the movement of the element 16 the roller 21 is turned by means of an actuator device, not illustrated, the roller 21 turning in contact with the strip 6. The rotation (in the anti-clockwise sense as seen in FIG. 1) of the roller 21 causes the tape 23 to advance towards the strip 6.

In particular, the rotation imparted by the roller 21 is such as to carry the tape 23 to adhere to the strip 6 with its center line in a position coincident with the said partial cut. Immediately after the formation of the said partial cut by the blades 14, 17, actuator means (not illustrated) for the rocker 47 are activated in such a way as to bring the movable jaw 46 into contact with the fixed jaw 45 so as to clamp the strip 6 coming from the reel 4. Following the stopping of the strip 6 by the jaws 45, 46 and due to the traction imparted to the strip 6 by the utiliser means, not illustrated, disposed downstream of the roller 25, the strip 6 snaps along the line of partial cut before said partial cut reaches the roller 21. Consequently the tape 23, applied across the line of partial cut, forms a connection between the part of the strip 6 disposed downstream of the line of partial cut and the part of the strip 7 disposed upstream of the line of partial cut.

The strips 6, 7 thus connected advance towards the blade 12 passing, as far as the portions disposed downstream of the line of partial cut are concerned, the first strip 6 to one side and the second strip 7 to the other of the blade 12. Blade 12 intercepts the strip 7 put under tension by the rollers 33, 34 and cuts it in correspondence with the partly cut line.

In conclusion, the tail of the strip 6 and the head of the strip 7, connected together by the tape 23 without any break, advance towards the rollers 24, 25 and the previously mentioned utiliser means (not illustrated) causing the unwinding of the reel 5 in place of the reel 6 which by now is nearly empty. Naturally, the principle of the invention remaining the same, numerous modifications would be possible to the reel changing device 1 described, without by this departing from the scope of the present invention.

I claim:

1. A method for replacing a first reel (4) nearly empty of strip material with a second new reel (5) on a user machine, the method comprising the steps of:

operating traction means (33, 34) so as to advance a second strip (7) on a second reel (5) at a speed the same as that of a first strip (6) on the first reel (4), and before the first reel (4) becomes empty;

advancing said two strips together overlying each other through cutting means (14, 17), and operating the same so as to simultaneously partially cut said two strips;

operating clamping means (45, 46) to stop the portion of said first strip (6) extending upstream from the partial cut performed by said cutting means (14, 17) on said two strips, and to snap said first strip (6) along said partial cut;

operating adhesive-applying means (21) to apply an adhesive material (23) astride said partial cut to connect the portion of the first strip (6) extending downstream from said partial cut to the portion of said second strip (7) extending upstream from said partial cut; and cutting said second strip (7) along said partial cut by means of a further cutting means (12).

2. A device for replacing a first, nearly empty reel (4) of strip material with a second, new reel (5) on a user machine, the device comprising:

first and second reels (4, 5) containing a first and a second strip (6, 7) respectively;

a support element (2) for said first and second reels (4, 5), traction means (33, 34) for advancing said second strip (7) at a speed equal to that of said first strip (6);

first cutting means (14, 17) for effecting a partial cut simultaneously to the said two strips (6, 7) in overlying position;

clamping means (45, 46) adapted to cooperate with, and stop, a portion of said first strip (6) extending upstream from said partial cut;

adhesive applicator means (21) for applying an adhesive material (23) astride said partial cut;

and, second cutting means (12) arranged downstream from said adhesive-applicator means (21) for cutting the said second strip (7) along the said partial cut.

3. A device according to claim 2, characterised by the fact that the said first cutting means (14,17) comprises a first blade (14) and a second blade (17) operable to cooperate with one another along respective discontinuous cutting edges (18).

4. A device according to claim 3, characterised by the fact that each of the said cutting edges (18) comprises a plurality of rectilinear cutting sections (19) separated from one another by notches (20).

5. A device according to claim 2, characterised by the fact that the said traction means (33,34) includes a drive chain (43, 38) in turn including a powder coupling (40).

* * * * *